US007609209B2

(12) United States Patent
Shih

(10) Patent No.: US 7,609,209 B2
(45) Date of Patent: Oct. 27, 2009

(54) ANTENNA DEVICE

(75) Inventor: Yen-Yi Shih, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 265 days.

(21) Appl. No.: 11/615,948

(22) Filed: Dec. 23, 2006

(65) Prior Publication Data

US 2008/0012775 A1 Jan. 17, 2008

(30) Foreign Application Priority Data

Jul. 14, 2006 (TW) ..... 95125813 A

(51) Int. Cl.
*H01Q 1/38* (2006.01)

(52) U.S. Cl. ..... 343/700 MS

(58) Field of Classification Search ..... 343/700 MS, 343/702, 747, 829, 846, 848
See application file for complete search history.

(56) References Cited

U.S. PATENT DOCUMENTS

| | | | | |
|---|---|---|---|---|
| 5,952,970 | A * | 9/1999 | Kawahata | 343/700 MS |
| 6,549,167 | B1 * | 4/2003 | Yoon | 343/700 MS |
| 6,965,346 | B2 | 11/2005 | Sung et al. | |
| 6,982,675 | B2 | 1/2006 | Kwak et al. | |
| 7,319,431 | B2 * | 1/2008 | Jeon et al. | 343/700 MS |
| 2003/0218573 | A1 * | 11/2003 | Yoo et al. | 343/702 |
| 2006/0044191 | A1 * | 3/2006 | Harihara | 343/700 MS |

FOREIGN PATENT DOCUMENTS

| | | |
|---|---|---|
| JP | 2006-054639 A | 2/2006 |
| TW | 543942 | 7/2003 |
| TW | I245458 | 12/2004 |
| TW | 200520314 | 6/2005 |
| TW | I242310 | 10/2005 |

* cited by examiner

*Primary Examiner*—Huedung Mancuso
(74) *Attorney, Agent, or Firm*—Wei Te Chung

(57) ABSTRACT

An antenna device disposed on a substrate includes a feed part, a body part, at least one ground plane, and a matching part. The feed part is for feeding electromagnetic signals. The body part for radiating and receiving the electromagnetic signals is electronically connected to the feed part. The body part includes a first radiation part located on a first plane, a second radiation part located on a second plane, and a third radiation part located on a third plane. The second radiation part is electronically connected between the first radiation part and the third radiation part. The ground plane for grounding is disposed on one surface of the substrate. The matching part for impedance matching includes one end electronically connected to one end of the body part and one end of the feed part, and another end electronically connected to the ground plane.

15 Claims, 6 Drawing Sheets

ANTENNA DEVICE

BACKGROUND OF THE INVENTION

1. Field of the Invention

The present invention relates to antenna devices, and particularly to an antenna device in a wireless local area network (WLAN) device.

2. Description of related art

Nowadays, wireless communication devices, such as mobile phone handsets and portable computers, are becoming more and more popular. In order to communicate with one or more base stations, the wireless devices have to be equipped with an antenna. The characteristics of the antenna, such as radiation efficiency, orientation, and impedance bandwidth, bring influence on performance of the wireless device. Recently, wireless communication devices are becoming more compact and lightweight. Consequently, antennas, as key elements of wireless communication devices, are desired to be made ever smaller and space-saving. Therefore, a need exists in the industry.

SUMMARY OF THE INVENTION

In one aspect of the invention, an antenna device disposed on a substrate includes a feed part, a body part, at least one ground plane, and a matching part. The feed part is for feeding electromagnetic signals. The body part for radiating and receiving the electromagnetic signals is electronically connected to the feed part. The body part includes a first radiation part located on a first plane, a second radiation part located on a second plane, and a third radiation part located on a third plane. The second radiation part is electronically connected between the first radiation part and the third radiation part. The ground plane for grounding is disposed on one surface of the substrate. The matching part for impedance matching includes one end electronically connected to one end of the body part and one end of the feed part, and another end electronically connected to the ground plane.

Other advantages and novel features will become more apparent from the following detailed description when taken in conjunction with the accompanying drawings, in which:

DETAILED DESCRIPTION OF THE INVENTION

Figure 1:
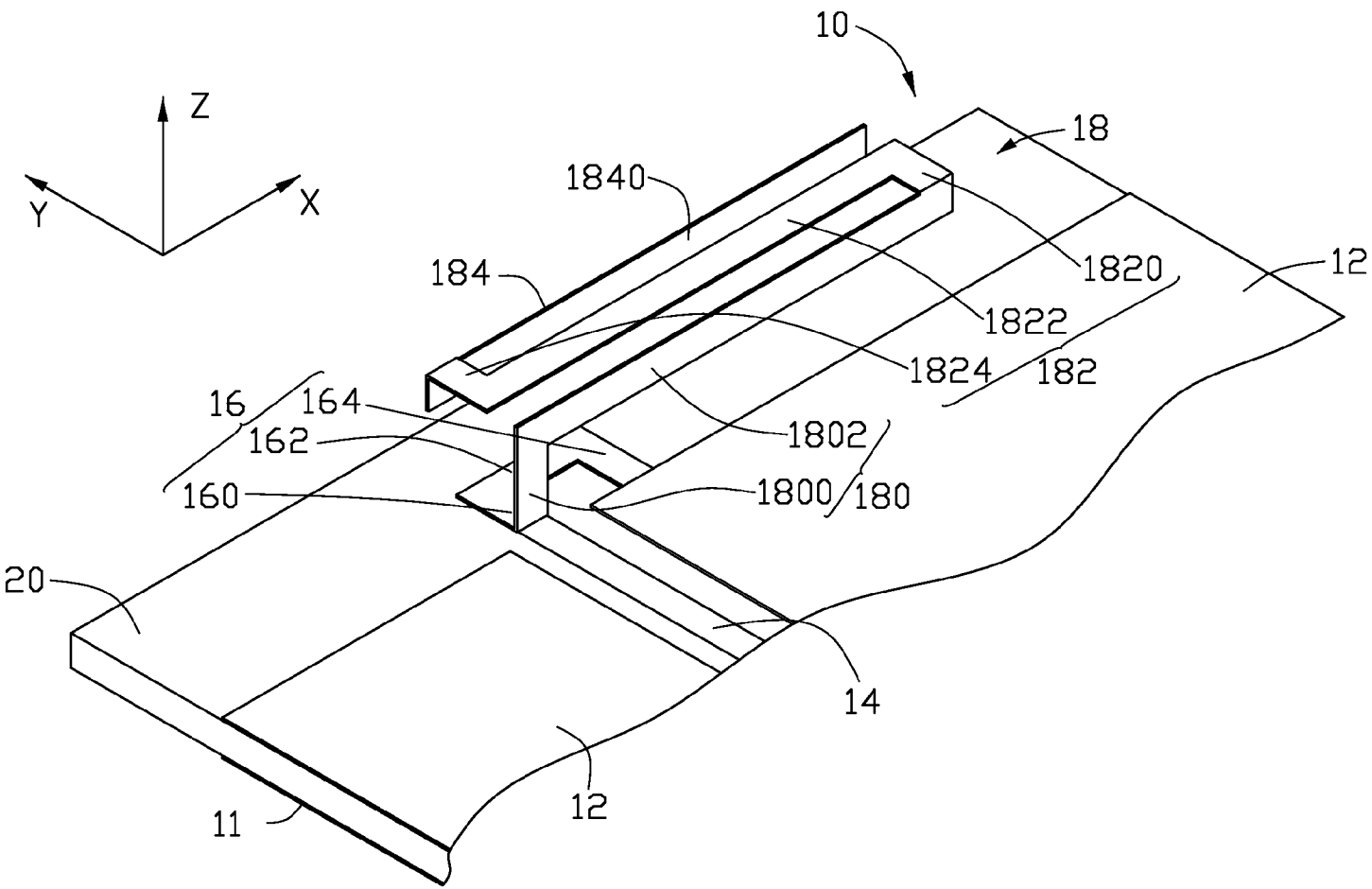
FIG. 1 is a schematic view of an antenna device according to an exemplary embodiment of the present invention.
Figure 2:
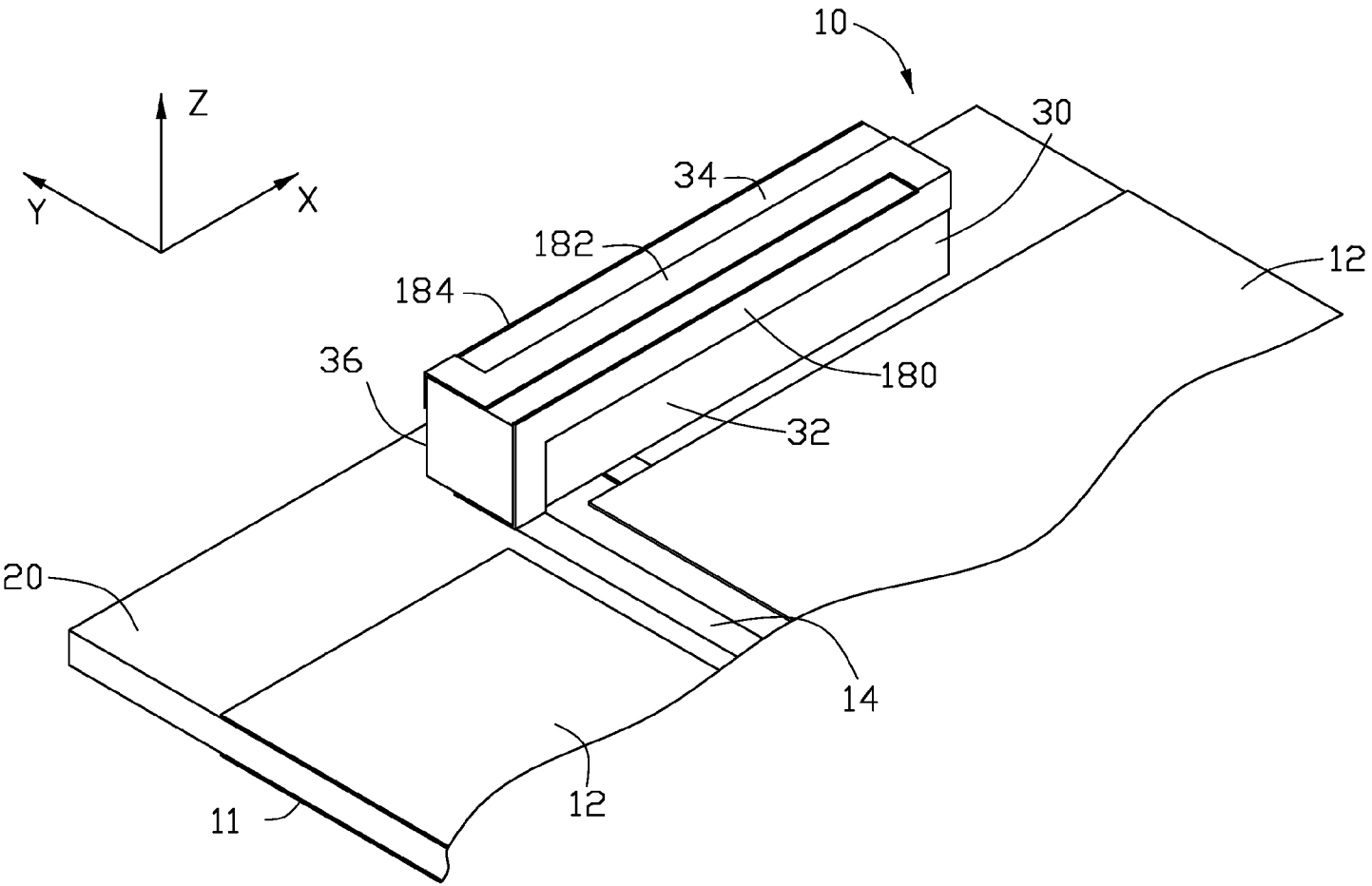
FIG. 2 is a schematic view of the antenna device of FIG. 1 disposed on a holder.

Referring to FIG. 1, an antenna device 10 according to an exemplary embodiment of the present invention is shown. Referring also to FIG. 2, the antenna device 10 of FIG. 1 is disposed on surfaces of a holder 30. The antenna device 10 includes a first ground plane 11, a second ground plane 12, a feed part 14, a matching part 16, and a body part 18.

The first ground plane 11 and the second ground plane 12 are disposed on two opposite surfaces of a substrate 20, and are used for grounding. The feed part 14 for feeding electromagnetic signals and the matching part 16 for impedance matching are disposed on the same surface of the substrate 20 as the second ground plane 12. The second ground plane 12 includes two parts disposed at two opposite sides of the feed part 14. The matching part 16, which is specifically realized as printed element has one end electronically connected to one end of the body part 18 and one end of the feed part 14, and has the other end electronically connected to the second ground plane 12. In the exemplary embodiment, a characteristic impedance of the feed part 14 is 50 ohm.

In the exemplary embodiment, the matching part 16 includes a first matching segment 160, a second matching segment 162, and a third matching segment 164. The first matching segment 160 is parallel to the third matching segment 164, and the second matching segment 162 is perpendicular to and electronically connected between the first matching segment 160 and the third matching segment 164. The first matching segment 160 is electronically connected to the body part 18 and feed part 14. The third matching segment 164 is electronically connected to the second ground plane 12. In the exemplary embodiment, the matching part 16 is designed as a printed element, which is electronically connected to the body part 18 made of metallic sheets.

The body part 18 for radiating and receiving the electromagnetic signals is disposed on at least two adjacent surfaces of the holder 30. The body part 18 projects on a plane where the matching part 16 is located. In the exemplary embodiment, the holder 30 is substantially rectangular. The body part 18 includes a first radiation part 180, a second radiation part 182, and a third radiation part 184. The second radiation part 182 is electronically connected between the first radiation part 180 and the third radiation part 184. The first radiation part 180, the second radiation part 182, and the third radiation part 184 are respectively planar.

In other exemplary embodiments, the body part 18 can include a plurality of radiation parts. For instance, when the holder is substantially orbicular, the body part 18 is also substantially orbicular, and the radiation parts of the body part 18 are numerous.

The holder 30 includes three adjacent surfaces, a first plane 32, a second plane 34, and a third plane 36. The first radiation part 180 is located at the first plane 32, the second radiation part 182 is located at the second plane 34, and the third radiation part 184 is located at the third plane 36. The first plane 32 is substantially parallel to the third plane 36, the second plane 34 is substantially perpendicular to the first plane 32 and the third plane 36, and the second plane 34 is substantially parallel to the substrate 20.

The first radiation part 180 includes a first radiation segment 1800 and a second radiation segment 1802. The first radiation segment 1800 is electronically connected to the matching part 16 and the feed part 14. The first radiation segment 1800 is perpendicular to the second radiation segment 1802 and a plane where the matching part 16 is located. The second radiation segment 1802 has one end electronically connected to the first radiation segment 1800 and the other end electronically connected to the second radiation part 182.

The second radiation part 182 includes a third radiation segment 1820, a fourth radiation segment 1822, and a fifth radiation segment 1824. The third radiation segment 1820 is parallel to the fifth radiation segment 1824, and the fourth radiation segment 1822 is perpendicular to and electronically connected between the third radiation segment 1820 and the fifth radiation segment 1824. The third radiation segment 1820 is perpendicular to the first plane 32, and has one end electronically connected to the fourth radiation segment 1822 and the other end electronically connected to the first radiation part 180. The fifth radiation segment 1824 is perpendicular to the third plane 36, and has one end electronically connected to the other end of the fourth radiation segment 1822 and the other end electronically connected to the third radiation part 184.

The third radiation part 184 includes a sixth radiation segment 1840. One end of the sixth radiation segment 1840 is electronically connected to the second radiation part 182, and the other end of the sixth radiation segment 1840 is an open end. In the exemplary embodiment, the sixth radiation segment 1840 is parallel to the second radiation segment 1802 of the first radiation part 180.

In the exemplary embodiment, the first radiation segment 1800, the second radiation segment 1802, the third radiation segment 1820, the fourth radiation segment 1822, the fifth radiation segment 1824, and the sixth radiation segment 1840 are respectively rectangular strips.

In the exemplary embodiment, a length and a width of the first radiation segment 1800 are respectively about 2 millimeter (mm) and 1 mm. A length and a width of the second radiation segment 1802 are respectively about 14.4 mm and 1 mm. A length and a width of the third radiation segment 1820 are respectively about 1 mm and 1 mm. A length and a width of the fourth radiation segment 1822 are respectively about 14.4 mm and 1 mm. A length and a width of the fifth radiation segment 1824 are respectively about 1 mm and 1 mm. A length and a width of the sixth radiation segment 1840 are respectively about 14.4 mm and 1 mm. A length and a width of the first matching segment 160 are respectively about 2 mm and 1 mm. A length and a width of the second matching segment 162 are respectively about 2 mm and 1 mm. A length and a width of the third matching segment 164 are respectively about 2 mm and 1 mm. In other exemplary embodiments, the above lengths and widths of elements of the antenna device 10 can be changed.

Figure 3:
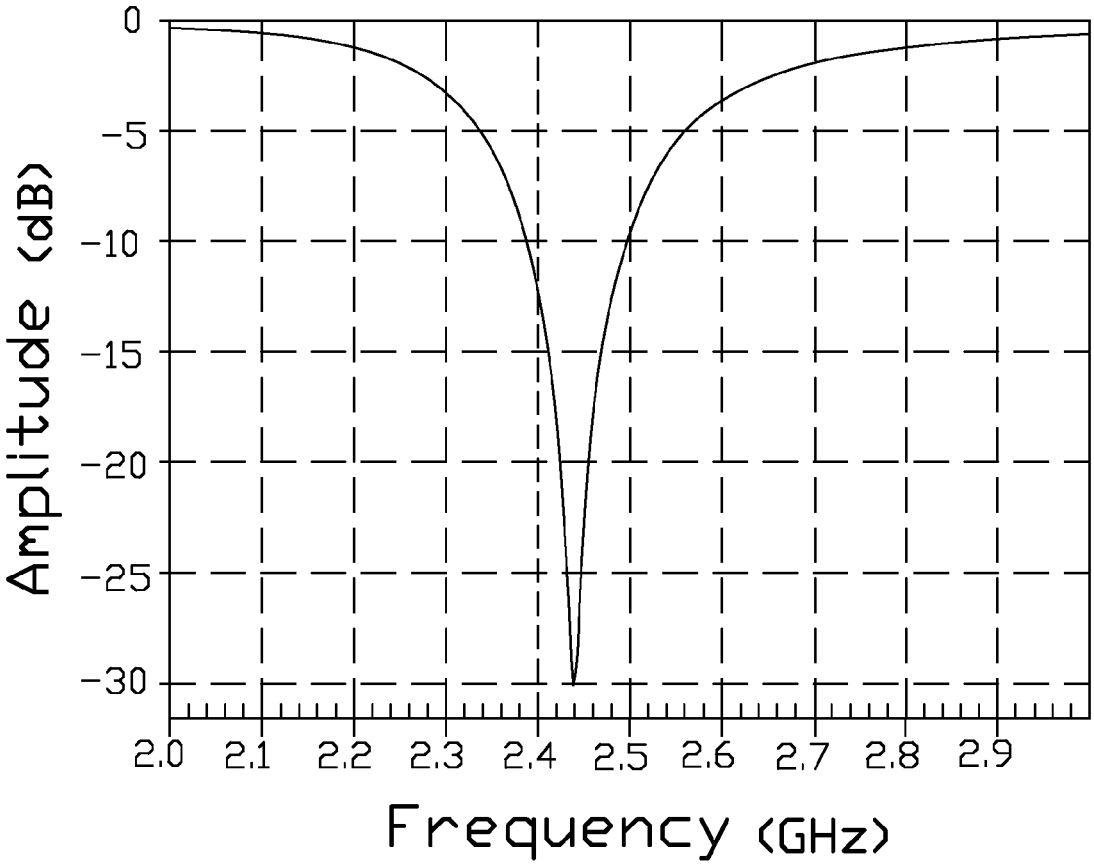
FIG. 3 is a graph of simulated test results showing reflection coefficients of the antenna device of FIG. 1.

FIG. 3 is a graph of simulated test results showing reflection coefficient of the antenna device 10 of FIG. 1. As shown, when the antenna device 10 operates at working frequency bands of 2.4~2.5 GHz, its reflection coefficient is less than −10 dB, which is capable of meeting operating standards set forth in IEEE 802.11b.

Figure 4:
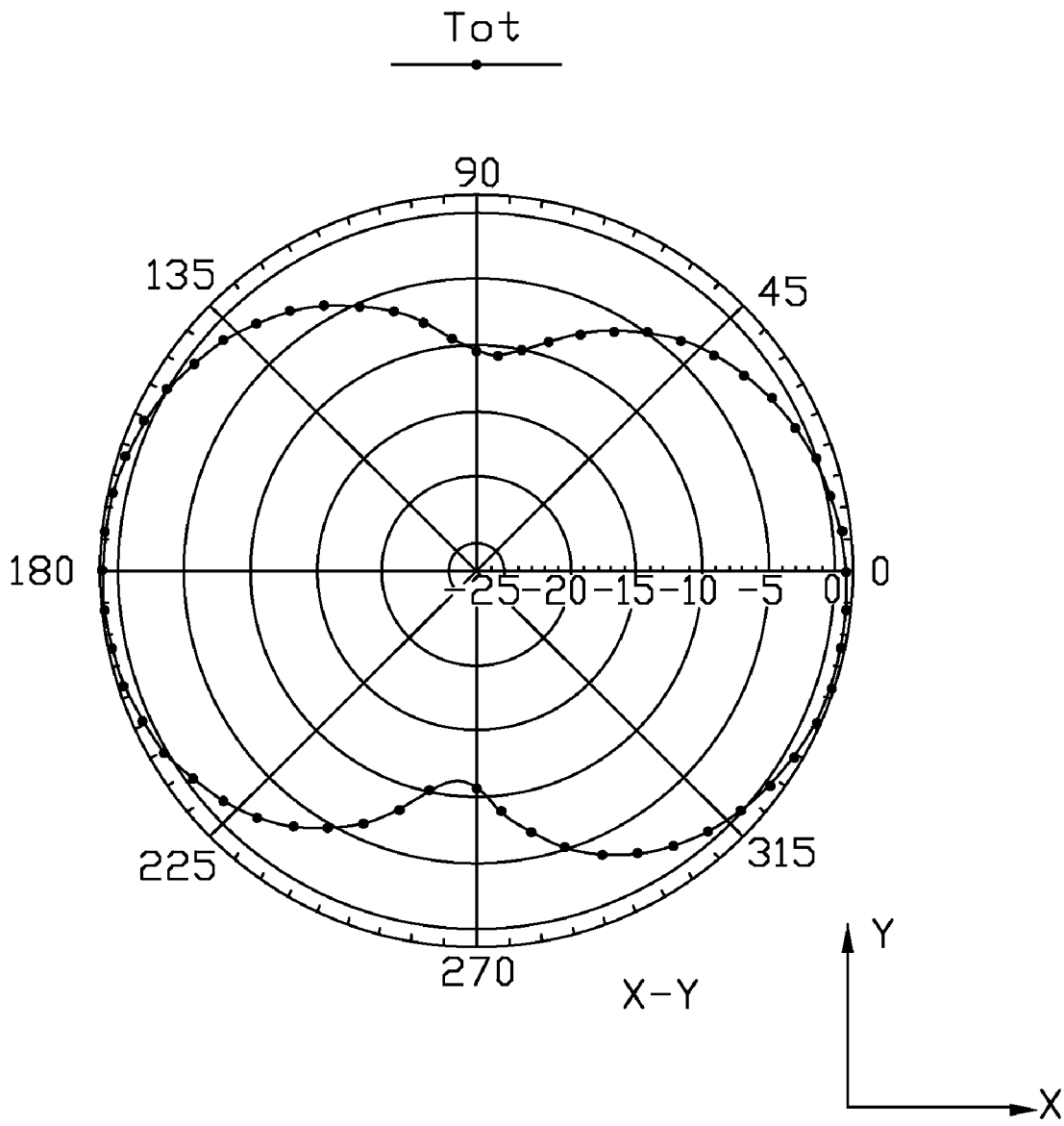
FIGS. 4-6 are graphs of simulated test results showing radiation patterns when the antenna device of FIG. 1 is operated at 2.44 GHz.
Figure 5:
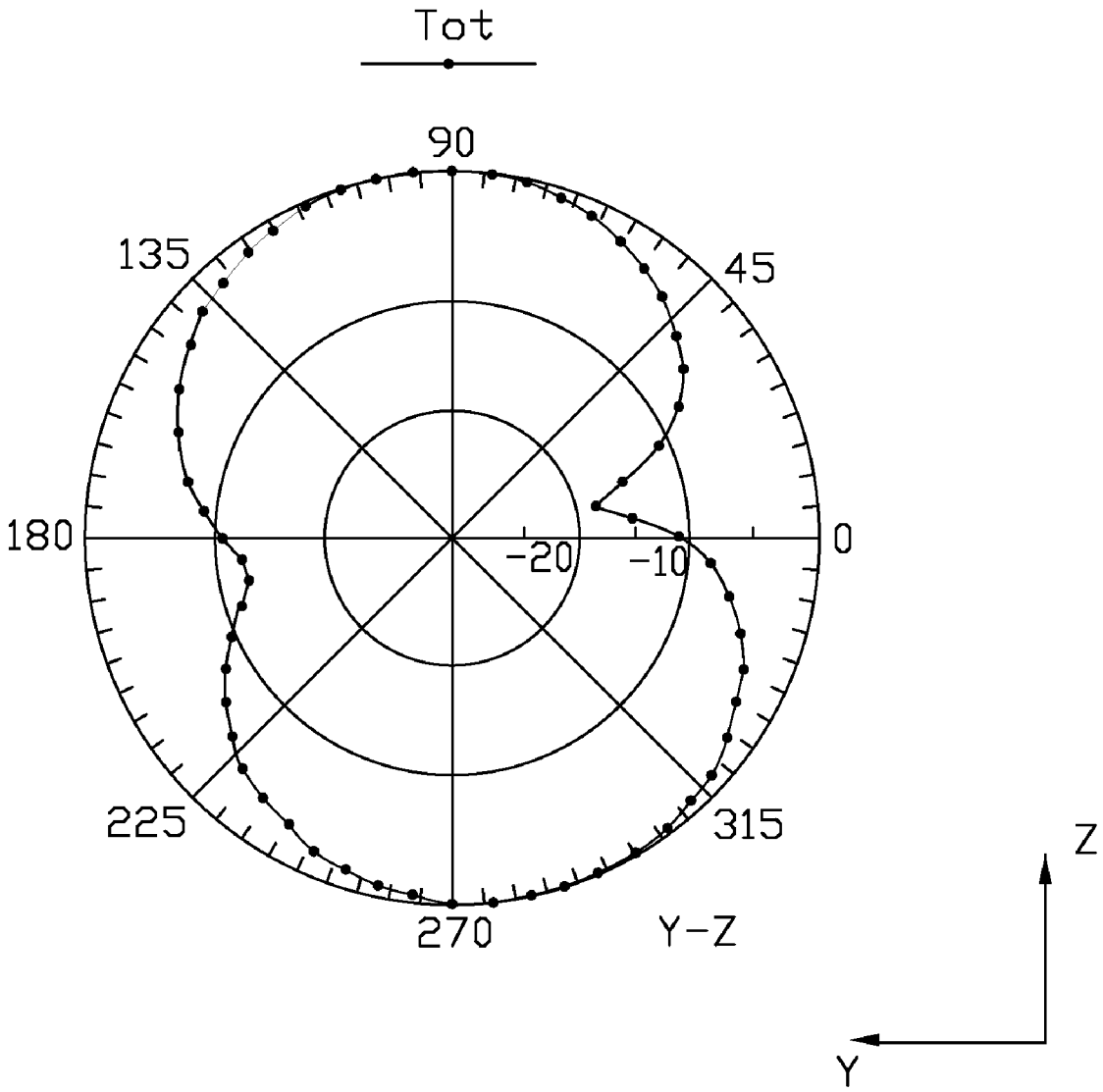
Figure 6:
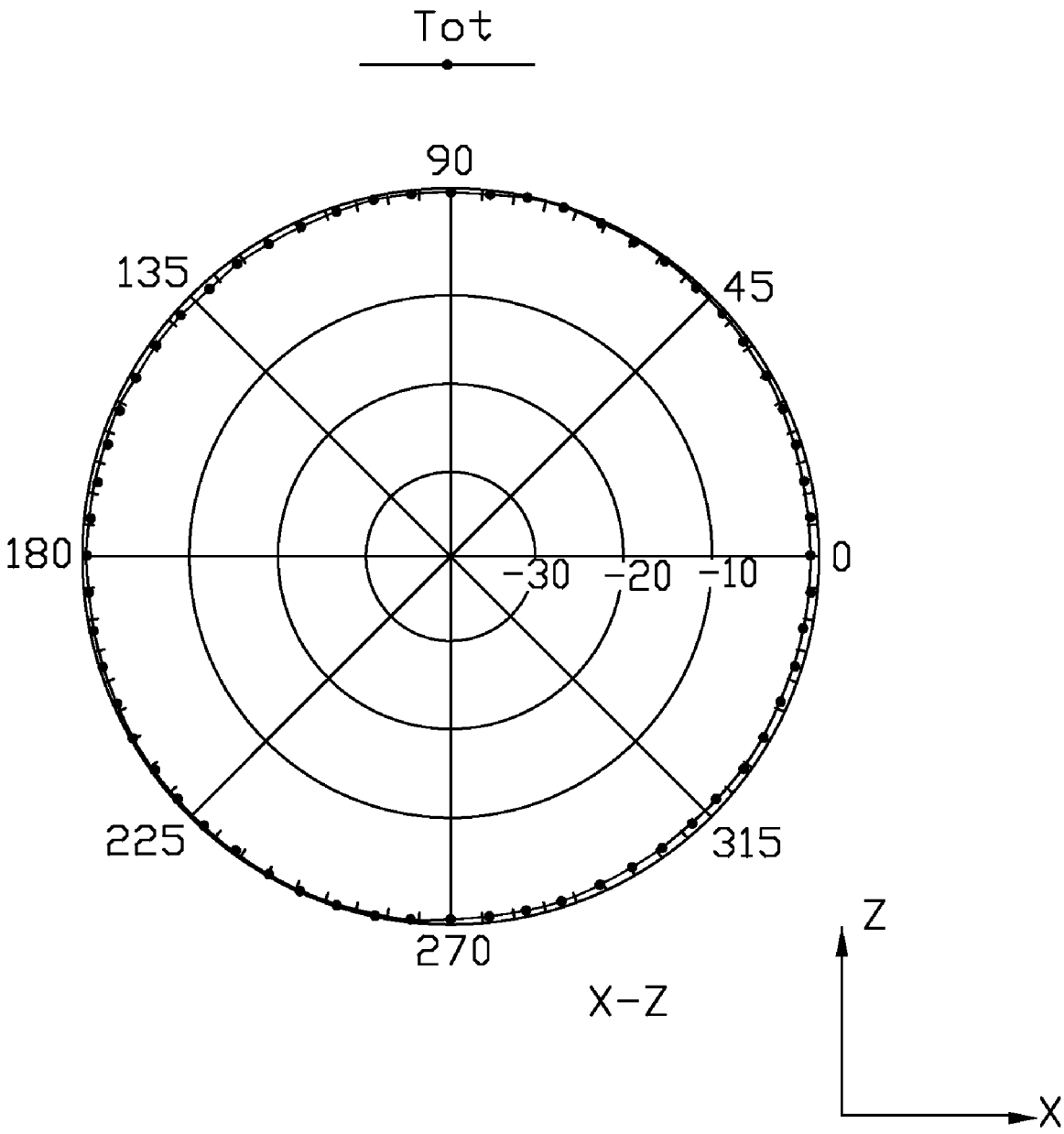

FIGS. 4-6 are graphs of simulated test results showing radiation patterns in horizontal and vertical planes when the antenna device 10 of FIG. 1 is operated at 2.44 GHz. It is to be noted that the radiation pattern is close to an omni-directional radiation pattern at X-Z plane when the antenna device 10 of the present invention is operated at 2.44 GHz.

While exemplary embodiments have been described above, it should be understood that they have been presented by way of example only and not by way of limitation. Thus the breadth and scope of the present invention should not be limited by the above-described exemplary embodiments, but should be defined only in accordance with the following claims and their equivalents.

What is claimed is:

1. An antenna device, disposed on a substrate, comprising:

a feed part, for feeding electromagnetic signals;

a body part, electronically connected to the feed part, for radiating and receiving the electromagnetic signals, comprising a first radiation part located on a first plane, a second radiation part located on a second plane, and a third radiation part located on a third plane, the second radiation part electronically connected between the first radiation part and the third radiation part; in which, the first plane, the second plane, and the third plane are different planes;

at least one ground plane, disposed on one surface of the substrate, for grounding; and a matching part, for impedance matching, comprising one end electronically connected to one end of the body part and one end of the feed part, and the other end electronically connected to the ground plane;

wherein the matching part comprises a first matching segment, a second matching segment, and a third matching segment, the first matching segment is parallel to the third matching segment, and the second matching segment is perpendicular to and electronically connected between the first matching segment and the third matching segment.

2. The antenna device of claim 1, wherein the first plane is parallel to the third plane, and the second plane is perpendicular to the first plane and the third plane.

3. The antenna device of claim 1, wherein the matching part and the ground plane are disposed on the same surface of the substrate.

4. The antenna device of claim 1, wherein the first radiation part comprises a first radiation segment and a second radiation segment, the first radiation segment is electronically connected to the matching part and the feed part, and the second radiation segment is electronically connected to the second radiation part.

5. The antenna device of claim 4, wherein the first radiation segment is perpendicular to the second radiation segment.

6. The antenna device of claim 4, wherein the first radiation part is perpendicular to a plane where the matching part is located.

7. The antenna device of claim 4, wherein the second radiation part comprises a third radiation segment, a fourth radiation segment, and a fifth radiation segment, the third radiation segment is electronically connected to the first radiation part, and the fifth radiation segment is electronically connected to the third radiation part.

8. The antenna device of claim 7, wherein the fourth radiation segment is perpendicular to and electronically connected to the third radiation segment and the fifth radiation segment.

9. The antenna device of claim 7, wherein the third radiation segment is perpendicular to the first plane, and the fifth radiation segment is perpendicular to the third plane.

10. The antenna device of claim 7, wherein the third radiation part comprises a sixth radiation segment having one end electronically connected to the second radiation part and the other open end.

11. The antenna device of claim 1, wherein the first matching segment is electronically connected to the body part, and the third matching segment is electronically connected to the ground plane.

12. The antenna device of claim 1, wherein the body part projects on a plane where the matching part is located.

13. The antenna device of claim 1, wherein the body part is disposed on surfaces of a holder.

14. The antenna device of claim 13, wherein the first plane, the second plane, and the third plane are adjacent surfaces of the holder.

15. The antenna device of claim 1, wherein the matching part is designed as a printed element, and the body part is made of metallic sheets.

* * * * *